US008836679B2

(12) United States Patent
Lin et al.

(10) Patent No.: US 8,836,679 B2
(45) Date of Patent: Sep. 16, 2014

(54) DISPLAY WITH MULTIPLEXER FEED-THROUGH COMPENSATION AND METHODS OF DRIVING SAME

(75) Inventors: Nan-Ying Lin, Hsinchu (TW); Yu-Hsin Ting, Hsinchu (TW); Chung-Lin Fu, Hsinchu (TW); Wei-Chun Hsu, Hsinchu (TW); Pei-Hua Chen, Hsinchu (TW)

(73) Assignee: AU Optronics Corporation, Hsinchu (TW)

( * ) Notice: Subject to any disclaimer, the term of this patent is extended or adjusted under 35 U.S.C. 154(b) by 130 days.

(21) Appl. No.: 13/567,582

(22) Filed: Aug. 6, 2012

(65) Prior Publication Data

US 2014/0035896 A1 Feb. 6, 2014

(51) Int. Cl.
*G09G 5/00* (2006.01)
*G09G 3/36* (2006.01)

(52) U.S. Cl.
CPC ..... *G09G 3/3611* (2013.01)
USPC ..... 345/204; 345/87; 345/100

(58) Field of Classification Search
CPC ..... G09G 3/36; G09G 3/3611; G09G 3/3644; G09G 3/3685; G09G 3/3696; G09G 3/3666; G09G 3/3688; G09G 2310/0297; G09G 3/3648; G09G 3/3677
USPC ..... 345/87–100, 204–214
See application file for complete search history.

(56) References Cited

U.S. PATENT DOCUMENTS

| | | | | |
|---|---|---|---|---|
| 7,903,072 | B2 * | 3/2011 | Yamazaki | 345/98 |
| 2004/0189681 | A1 * | 9/2004 | Itakura et al. | 345/698 |
| 2005/0156830 | A1 | 7/2005 | Tobita | |
| 2009/0109203 | A1 * | 4/2009 | Washio et al. | 345/208 |
| 2011/0205194 | A1 * | 8/2011 | Takahashi et al. | 345/204 |

* cited by examiner

*Primary Examiner* — Hong Zhou
(74) *Attorney, Agent, or Firm* — Tim Tingkang Xia, Esq.; Morris Manning & Martin, LLP

(57) ABSTRACT

In one aspect, an LCD includes a display panel with a pixel matrix having M scan lines and N data lines, and a multiplexer feed-through compensation circuit, which includes P signal lines for providing P video signals, P multiplexers, and K pairs of control lines providing K pairs of control signals. Each multiplexer is electrically coupled to a corresponding signal line and has K channels. Each channel includes first and second switches parallel-connected between the signal line and a corresponding data line for selectively transmitting the video signal to the corresponding data line. Each pair of control lines is respectively electrically coupled to the first and second switches of a corresponding channel of each multiplexer. Each pair of control signals are configured such that a time turning off one of the first and second switches is earlier than that turning off the other switch.

8 Claims, 11 Drawing Sheets

DISPLAY WITH MULTIPLEXER FEED-THROUGH COMPENSATION AND METHODS OF DRIVING SAME

FIELD OF THE INVENTION

The disclosure relates generally to display technology, and more particularly to a display with multiplexer feed-through compensation and methods of driving the same.

BACKGROUND OF THE INVENTION

With the developments and applications of electronic products, there has been increasing demand for flat panel displays that consume less electric power and occupy less space. Among flat panel displays, liquid crystal displays (LCDs) are characterized by thin appearance and low power consumption, and have been widely applied in various electronic products such as computer monitors, mobile phones, personal digital assistants (PDAs), or flat panel televisions.

A typical LCD includes a display panel and the driving circuits. The display panel has a plurality of pixels arranged in a matrix having a plurality of pixel rows and a plurality of pixel columns, a plurality of scan lines with each electrically coupled to a corresponding pixel row, and a plurality of data lines with each electrically coupled to a corresponding pixel column. The driving circuits include a plurality of signal lines for providing a plurality of image signals to be displayed, and a plurality of multiplexers with each electrically coupled between a signal line and certain data lines for selectively transmitting an image signal provided from the signal line to a corresponding pixel column electrically coupled to one of the certain data lines. Typically, each multiplexer has a plurality of switches for selectively transmitting the image signal to the corresponding pixel column. In operation, when one of the switches is turned off by the control signal, the voltage for charging the corresponding data line drop, thus resulting in a feed-through voltage drop. Usually, the channel widths of the switches of each multiplexer are increased to provide better charging capability for the data lines. However, the increased channel widths of the switches leads to large feed-through voltage drops. Accordingly, additional compensation circuits are required for the recovery of the large feed-through voltage drops.

Therefore, a heretofore unaddressed need exists in the art to address the aforementioned deficiencies and inadequacies.

SUMMARY OF THE INVENTION

The present invention, in one aspect, relates to a display. In one embodiment, the display includes: (a) a display panel having a plurality of pixels arranged in a matrix having M pixel rows and N pixel columns, M scan lines electrically coupled to M pixel rows, respectively, and N data lines electrically coupled to N pixel columns, respectively, where M and N are integers greater than one; (b) P signal lines, $\{SL_i\}$, for providing P video signals, $\{VS_i\}$, to be displayed, where i=1, 2, . . . , P, and P is an integer greater than one; (c) P multiplexers, $\{MUX_i\}$, where each multiplexer $MUX_i$ has an input electrically coupled to a corresponding signal line $SL_i$ for receiving a corresponding video signal $VS_i$ therefrom, and K channels, $\{CH_j\}$, each channel $CH_j$ comprising a first switch $SWX_j$ and a second switch $SWY_j$ parallel-connected between the input and a corresponding data line, for selectively transmitting the video signal $VS_i$ to the corresponding data line, where j=1, 2, . . . , K, and K is an integer greater than one; and (d) K pairs of control lines, $\{CLX_j, CLY_j\}$, for providing K pairs of control signals, $\{CTRLX_j, CTRLY_j\}$, respectively, where each pair of control lines $CLX_j$ and $CLY_j$ is respectively and electrically coupled to the first and second switches $SWX_j$ and $SWY_j$ of a corresponding channel $CH_j$ of each multiplexer $MUX_i$ for providing a corresponding pair of control signals $CTRLX_j$ and $CTRLY_j$ for turning on or off the first and second switches $SWX_j$ and $SWY_j$ thereof, thereby selectively transmitting the video signal $VS_i$ to the corresponding data line, where each pair of control signals $CTRLX_j$ and $CTRLY_j$ are configured such that a time turning off one of the first and second switches $SWX_j$ and $SWY_j$ is earlier than that turning off the other of the first and second switches $SWX_j$ and $SWY_j$.

In another aspect, the present invention discloses a multiplexer circuit for a display panel, where the display panel has a plurality of pixels arranged in a matrix having M pixel rows and N pixel columns, M scan lines electrically coupled to M pixel rows, respectively, and N data lines electrically coupled to N pixel columns, respectively, where M and N are integers greater than one. The multiplexer feed-through compensation circuit includes: (a) P multiplexers, $\{MUX_i\}$, where each multiplexer $MUX_i$ has an input electrically coupled to a corresponding signal line $SL_i$ for receiving a corresponding video signal $VS_i$ therefrom, and K channels, $\{CH_i\}$, each channel $CH_j$ comprising a first switch $SWX_j$ and a second switch $SWY_j$ parallel-connected between the input and a corresponding data line, for selectively transmitting the video signal $VS_i$ to the corresponding data line, where i=1, 2, . . . , P, j=1, 2, . . . , K, and P and K are integers greater than one; and (b) K pairs of control lines, $\{CLX_j, CLY_j\}$, for providing K pairs of control signals, $\{CTRLX_j, CTRLY_j\}$, respectively, where each pair of control lines $CLX_j$ and $CLY_j$ is respectively and electrically coupled to the first and second switches $SWX_j$ and $SWY_j$ of a corresponding channel $CH_j$ of each multiplexer $MUX_i$ for providing a corresponding pair of control signals $CTRLX_j$ and $CTRLY_j$ for turning on or off the first and second switches $SWX_j$ and $SWY_j$ thereof, thereby selectively transmitting the received signal line $SL_i$ to the corresponding data line, where each pair of control signals $CTRLX_j$ and $CTRLY_j$ are configured such that a time turning off one of the first and second switches $SWX_j$ and $SWY_j$ is earlier than that turning off the other of the first and second switches $SWX_j$ and $SWY_j$.

In yet another aspect, the present invention discloses a method for driving a display panel having a plurality of pixels arranged in a matrix having M pixel rows and N pixel columns, M scan lines electrically coupled to M pixel rows, respectively, and N data lines electrically coupled to N pixel columns, respectively, where M and N are integers greater than one. The method in one embodiment includes the steps of providing a multiplexer feed-through compensation circuit comprising: P multiplexers, $\{MUX_i\}$, where each multiplexer $MUX_i$ has an input electrically coupled to a corresponding signal line $SL_i$ for receiving a corresponding video signal $VS_i$ therefrom, and K channels, $\{CH_j\}$, each channel $CH_j$ comprising a first switch $SWX_j$ and a second switch $SWY_j$ parallel-connected between the input and a corresponding data line, for selectively transmitting the video signal $VS_i$ to the corresponding data line, where i=1, 2, . . . , P, j=1, 2, . . . , K, and P and K are integers greater than one; and K pairs of control lines, $\{CLX_j, CLY_j\}$, where each pair of control lines $CLX_j$ and $CLY_j$ is respectively and electrically coupled to the first and second switches $SWX_j$ and $SWY_j$ of a corresponding channel $CH_j$ of each multiplexer $MUX_i$.

The method also includes the step of applying K pairs of control signals, $\{CTRLX_j, CTRLY_j\}$, to the K pairs of control lines $\{CLX_j, CLY_j\}$, respectively, such that each pair of control signals $CTRLX_j$ and $CTRLY_j$ is respectively and electrically coupled to the first and second switches $SWX_j$ and $SWY_j$ of the corresponding channel $CH_j$ of each multiplexer $MUX_i$ for turning on or off the first and second switches $SWX_j$ and $SWY_j$ thereof, thereby selectively transmitting the received signal line $SL_i$ to the corresponding data line. Each pair of control signals $CTRLX_j$ and $CTRLY_j$ are configured such that a time turning off one of the first and second switches $SWX_j$ and $SWY_j$ is earlier than that turning off the other of the first and second switches $SWX_j$ and $SWY_j$.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
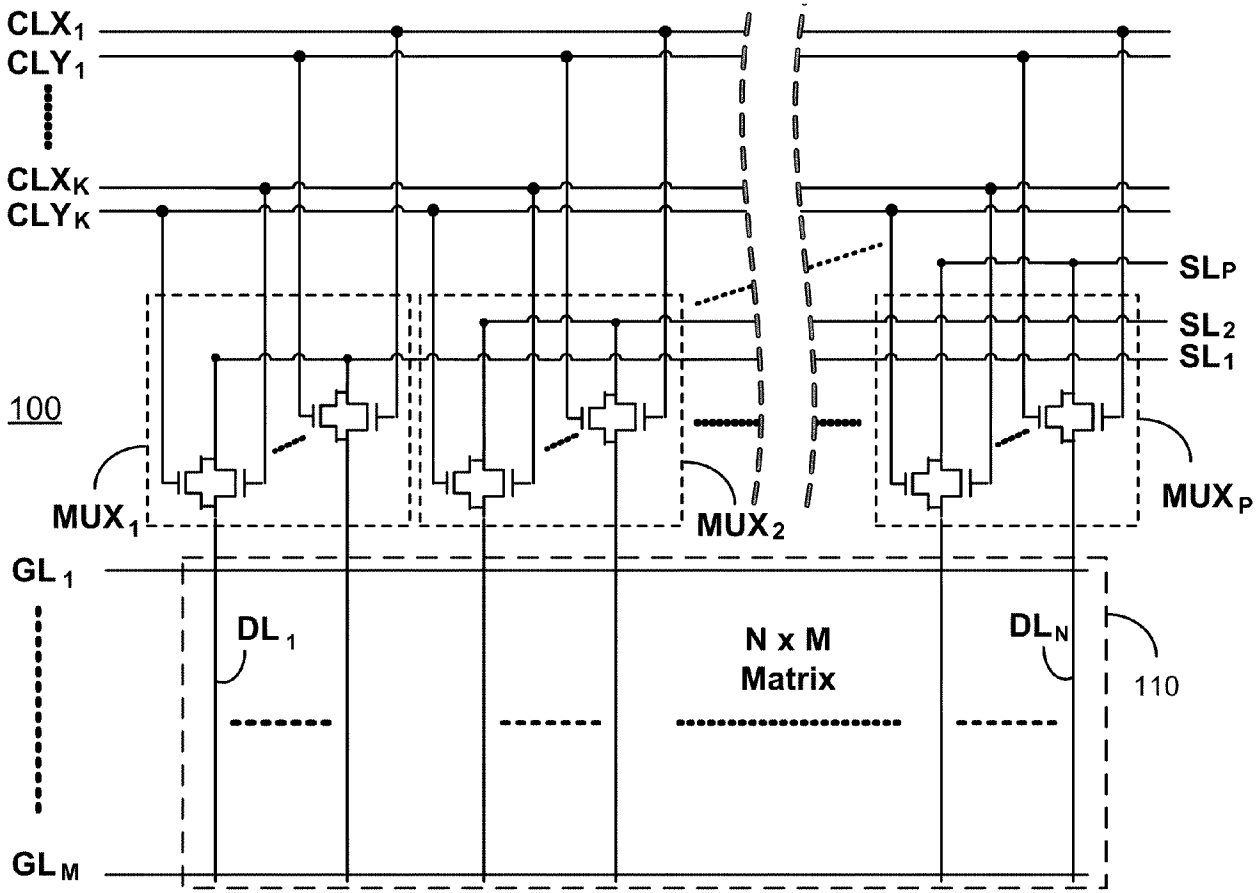
FIG. 1 shows schematically an LCD according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top", may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper", depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

The description will be made as to the embodiments of the present invention in conjunction with the accompanying drawings in FIGS. 1-4D. In accordance with the purposes of this invention, as embodied and broadly described herein, this invention, in one aspect, relates to a display with multiplexer feed-through compensation and methods of driving the same. The display can be an LCD or other types of displays.

The display, in one embodiment, includes a display panel and the driving circuits. The display panel has an active area, in which a plurality of pixels arranged in a matrix. For example, an active area with an M*N pixel matrix has M pixel rows and N pixel columns, where M and N are integers greater than one. Further, M scan lines are electrically coupled to the M pixel rows, respectively, and N data lines are electrically coupled to the N pixel columns, respectively.

The driving circuits include a plurality of signal lines, a plurality of control lines and a plurality of multiplexers. Each multiplexer has a plurality of channels, each channel having a pair of switches parallel-connected between a signal line and a data line. Each control line is electrically connected to one of the switches of each multiplexer. For example, the driving circuit includes P signal lines, K pairs of control lines and P multiplexers, where P and K are integers greater than one. The P multiplexers correspond to the P signal lines, respectively. Each multiplexer has K channels. Each channel has a pair of switches electrically parallel-connected to one another, and is electrically connected between a corresponding signal lines and a corresponding data line. Each pair of the control lines is electrically connected to the pair of switches of a corresponding channel of each multiplexer.

In operation, the P signal lines provide video signals to the P multiplexers, and the K pairs of control lines provide control signals to the corresponding channels of each multiplexer to turn on/off switches so as to selectively transmitting the video signals to corresponding pixel columns to charge them accordingly.

Referring to FIG. 1, a display is schematically shown according to one embodiment of the present invention. In this exemplary embodiment, the LCD includes a display panel 110, P signal lines $\{SL_i\}$, P multiplexers $\{MUX_i\}$, and K pairs of control lines $\{CLX_j, CLY_j\}$, where i=1, 2, . . . , P, j=1, 2, . . . , K, and P and K are integers greater than one, respectively. The P signal lines $\{SL_i\}$, P multiplexers $\{MUX_i\}$, and K pairs of control lines $\{CLX_j, CLY_j\}$ forms a multiplexer feed-through compensation circuit of the LCD.

The display panel 110 has an active area, in which a plurality of pixels is arranged in a matrix having M pixel rows and N pixel columns, forming M*N pixels in the active area, where M and N are integers greater than one. M scan lines $GL_1, \ldots, GL_M$ are electrically coupled to the M pixel rows of the matrix, respectively. Further, N data lines $DL_1, \ldots, DL_N$ are electrically coupled to the N pixel columns of the matrix, respectively.

The P signal lines, $\{SL_i\}$, are configured for providing P video signals, $\{VS_i\}$, to be displayed. The K pairs of control lines, $\{CLX_j, CLY_j\}$, are configured for providing K pairs of control signals, $\{CTRLX_j, CTRLY_j\}$, respectively. Each of the P multiplexers $MUX_i$ has an input electrically coupled to a corresponding signal line $SL_i$ for receiving a corresponding video signal $VS_i$ therefrom, and K channels, $\{CH_j\}$ corresponding to the K pairs of control lines $\{CLX_j, CLY_j\}$.

Figure 2A:
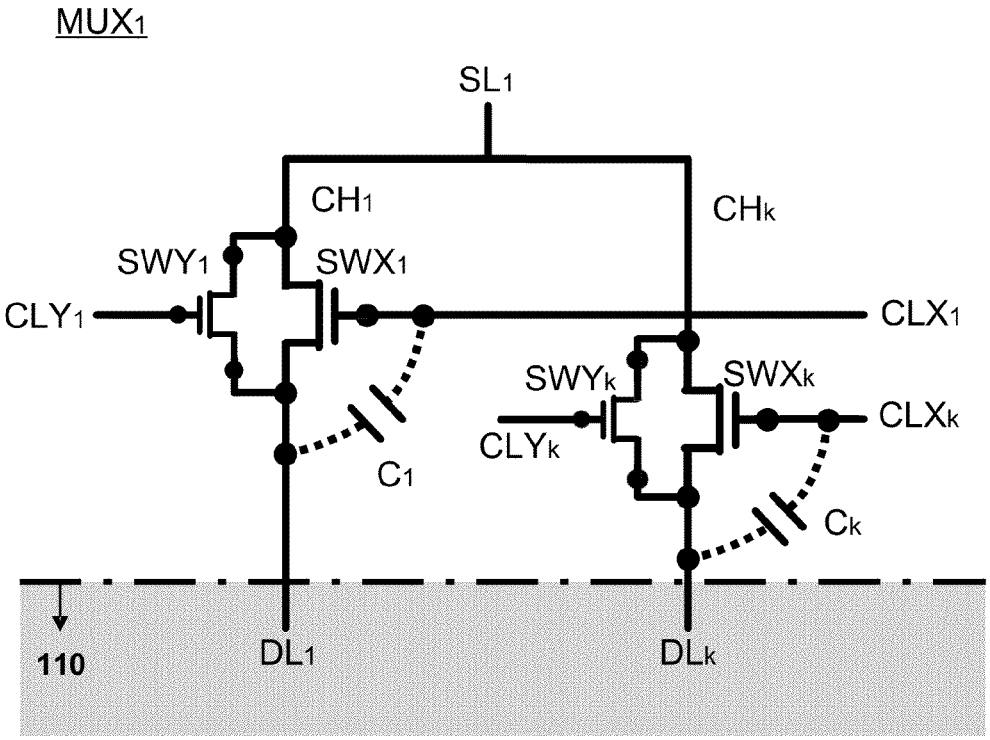
FIG. 2A shows schematically a multiplexer $MUX_1$ of an LCD according to one embodiment of the present invention.

FIG. 2A shows schematically a multiplexer $MUX_1$ of an LCD according to one embodiment of the present invention. As described above, the multiplexer $MUX_1$ has K channels $\{CH_j\}$. For better illustration purposes, FIG. 2A shows only the first channel $CH_1$ and the K-th channel $CH_k$.

As shown in FIG. 2A, each channel $CH_j$ includes a first switch $SWX_j$ and a second switch $SWY_j$ parallel-connected between the input and a corresponding data line, for selectively transmitting a video signal $VS_i$ received from the signal line $SL_i$ to the corresponding data line. For example, the first channel $CH_1$ includes a first switch $SWX_1$ and a second switch $SWY_1$ parallel-connected between the input, i.e., the signal line $SL_1$ and a corresponding data line $DL_1$, and the K-th channel $CH_k$ includes a first switch $SWX_k$ and a second switch $SWY_k$ parallel-connected between the input, i.e., the signal line $SL_1$ and a corresponding data line $DL_k$. As such, by turning on/of the switches of each channel of the multiplexer $MUX_1$, the video signal $VS_1$ received from the signal line $SL_i$ can be selectively transmitted to a desired data line $DL_1$, thereby charging pixels of the corresponding pixel column.

Further, each pair of control lines $CLX_j$ and $CLY_j$ is respectively and electrically coupled to the first and second switches $SWX_j$ and $SWY_j$ of a corresponding channel $CH_j$ of each multiplexer $MUX_i$ for providing a corresponding pair of control signals $CTRLX_j$ and $CTRLY_j$ for turning on or off the first and second switches $SWX_j$ and $SWY_j$ thereof, thereby selectively transmitting a video signal $VS_i$ received from the signal line $SL_i$ to the corresponding data line. For example, the first pair of control lines $CLX_1$ and $CLY_1$ is respectively and electrically coupled to the first and second switches $SWX_1$ and $SWY_1$ of the first channel $CH_1$ for providing a corresponding pair of control signals $CTRLX_1$ and $CTRLY_1$ for turning on or off the first and second switches $SWX_1$ and $SWY_1$ thereof. The K-th pair of control lines $CLX_k$ and $CLY_k$ is respectively and electrically coupled to the first and second switches $SWX_k$ and $SWY_k$ of the K-th channel $CH_k$ for providing a corresponding pair of control signals $CTRLX_k$ and $CTRLY_k$ for turning on or off the first and second switches $SWX_k$ and $SWY_k$ thereof.

Each pair of control signals $CTRLX_j$ and $CTRLY_j$ are configured such that a time turning off one of the first and second switches $SWX_j$ and $SWY_j$ is earlier than that turning off the other of the first and second switches $SWX_j$ and $SWY_j$. For example, the first switch $SWX_j$ is turned off at a time earlier than that of the second switch $SWY_j$.

Additionally, each channel $CH_j$ may include a feed-through capacitor $C_j$ electrically coupled between the control line $CLX_j$ and the corresponding data line. For example, the feed-through capacitor $C_1$ is electrically coupled between the control line $CLX_1$ and the corresponding data line $DL_1$, and the feed-through capacitor $C_k$ is electrically coupled between the control line $CLX_k$ and the corresponding data line $DL_k$.

As shown in FIG. 2A, each channel $CH_j$ of each multiplexer $MUX_i$ corresponds to one data line. Thus, the total number N of the data lines $\{DL_1, \ldots, DL_N\}$ is determined by the number P of the multiplexers $\{MUX_i\}$ and the number K of the channels $\{CH_j\}$. In other words, P*K=N.

In operation, the K pairs of control signals $\{CTRLX_j, CTRLY_j\}$ are applied to the K pairs of control lines $\{CLX_j, CLY_j\}$, respectively, such that each pair of control signals $CTRLX_j$ and $CTRLY_j$ is respectively and electrically coupled to the first and second switches $SWX_j$ and $SWY_j$ of the corresponding channel $CH_j$ of each multiplexer $MUX_i$ for turning on or off the first and second switches $SWX_j$ and $SWY_j$ thereof, thereby selectively transmitting a video signal $VS_i$ received from the signal line $SL_i$ to the corresponding data line. As disclosed below, for such a configuration of the LCD and the control signals disclosed above, the voltage drop caused by the feed-through effect is substantially reduced.

In one embodiment, each of the first and second switches $SWX_j$ and $SWY_j$ of each channel $CH_j$ of each multiplexer $MUX_i$ has a channel width. In one embodiment, the channel width of the first switch $SWX_j$ is identical to that of the second switch $SWY_j$. In another embodiment, the channel width of the first switch $SWX_j$ is different from that of the second switch $SWY_j$.

In some embodiments, the first and second switches $SWX_j$ and $SWY_j$ of each channel $CH_j$ of each multiplexer $MUX_i$ are analog switches, such as transistors. For example, as shown in FIG. 2A, each of the first and second switches $SWX_j$ and $SWY_j$ of each channel $CH_j$ of each multiplexer $MUX_i$ comprises a transistor having a gate, a source and a drain, where the gate, the source and the drain of the first switch $SWX_j$ are electrically coupled to the control signal $CTRLX_j$ of the pair of control signals $CTRLX_j$ and $CTRLY_j$, the input of the multiplexer MUX and the corresponding data line, respectively, and the gate, the source and the drain of the second switch $SWY_j$ are electrically coupled to the control signal $CTRLY_j$ of the pair of control signals $CTRLX_j$ and $CTRLY_j$, the source of the first switch $SWX_j$ and the drain of the first switch $SWX_j$, respectively.

In one embodiment, the transistors are the metal-oxide-semiconductor field-effect transistors (MOSFETS).

In one embodiment, the first and second switches $SWX_j$ and $SWY_j$ of each channel $CH_j$ of each multiplexer $MUX_i$ have a same conductivity type or different conductive types. For example, in one embodiment, the first and second switches $SWX_j$ and $SWY_j$ are P-type MOSFETS. In another embodiment, the first and second switches $SWX_j$ and $SWY_j$ are N-type MOSFETS. In a further embodiment, one of the first and second switches $SWX_j$ and $SWY_j$ is a P-type MOSFET, and the other of the first and second switches $SWX_j$ and $SWY_j$ is a N-type MOSFET. Each pair of control signals $CTRLX_j$ and $CTRLY_j$ is corresponding to the conductivity types of the first and second switches $SWX_j$ and $SWY_j$.

In certain embodiments, each pair of control signals $CTRLX_j$ and $CTRLY_j$ are configured such that a time turning off one of the first and second switches $SWX_j$ and $SWY_j$ is earlier than that turning off the other of the first and second switches $SWX_j$ and $SWY_j$. For example, in one embodiment, the first switch $SWX_j$ is turned off at a time earlier than that of the second switch $SWY_j$.

Figure 2B:
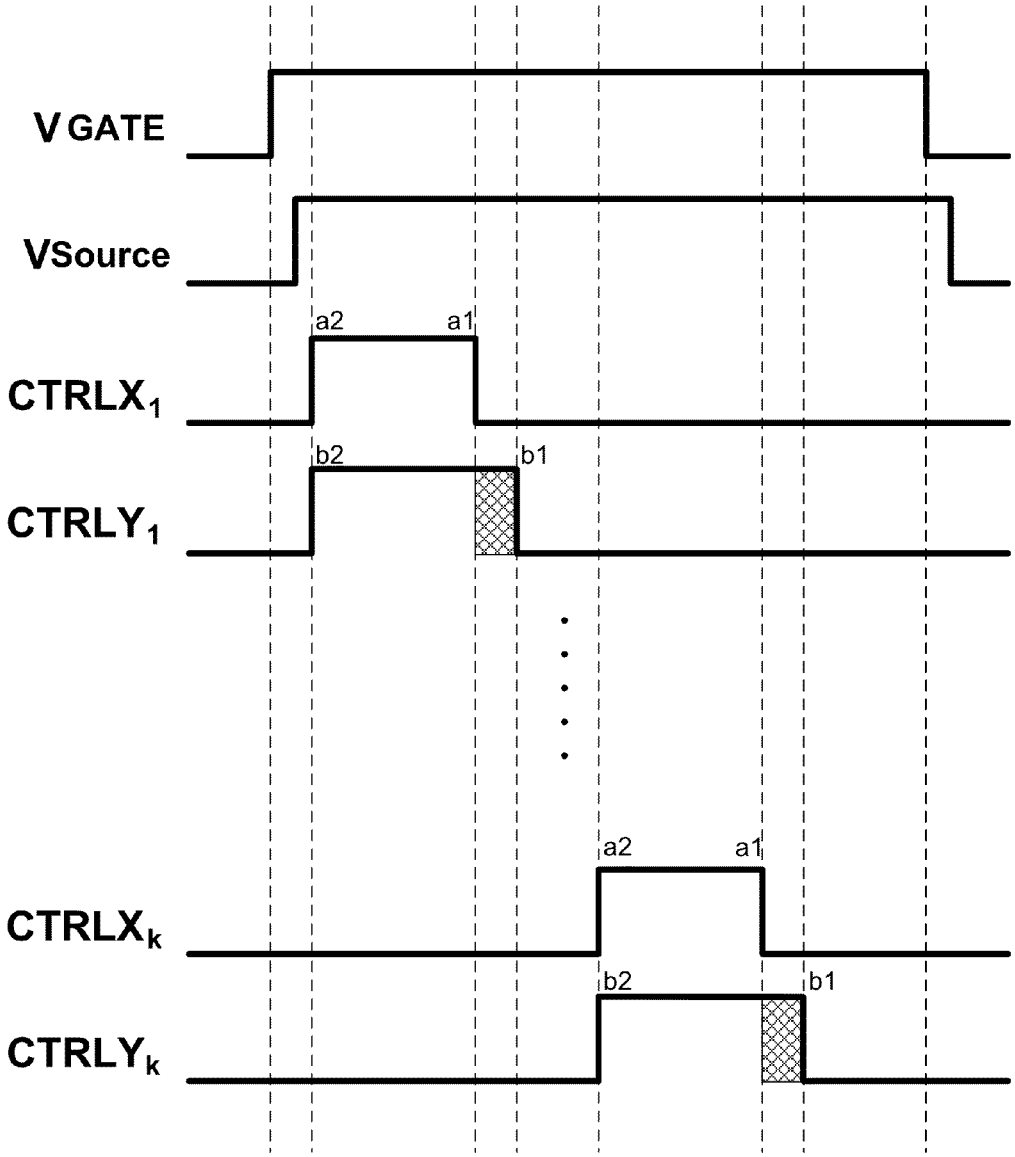
FIG. 2B shows schematically waveforms of the control signals of the multiplexer $MUX_1$ shown in FIG. 2A according to one embodiment of the present invention.

FIG. 2B shows schematically waveforms of the control signals of the multiplexer $MUX_1$ shown in FIG. 2A according to one embodiment of the present invention. As shown in FIG. 2B, each of the pair of control signals $CTRLX_j$ and $CTRLY_j$ has a waveform defined by a low voltage, a high voltage, a rising edge from the low voltage to the high voltage at a rising time, a2/b2, and a falling edge from the high voltage to the low voltage at a falling time, a1/b1, in a period. For each control signal $CTRLX_j/CTRLY_j$, the rising time a2/b2 is the time turning on a corresponding switch $SWX_j/SWY_j$, and the falling time a1/b1 is the time turning off the corresponding switch $SWX_j/SWY_j$. For each control signal $CTRLX_j/CTRLY_j$, the rising time a2/b2 is earlier than the falling time a1/b1. Further, the falling time a1 of the control signal $CTRLX_j$ (the time turning off the corresponding first switch $SWX_j$) is earlier than the falling time b1 of the control signal $CTRLY_j$ (the time turning off the corresponding second switch $SWY_j$).

Figure 2C:
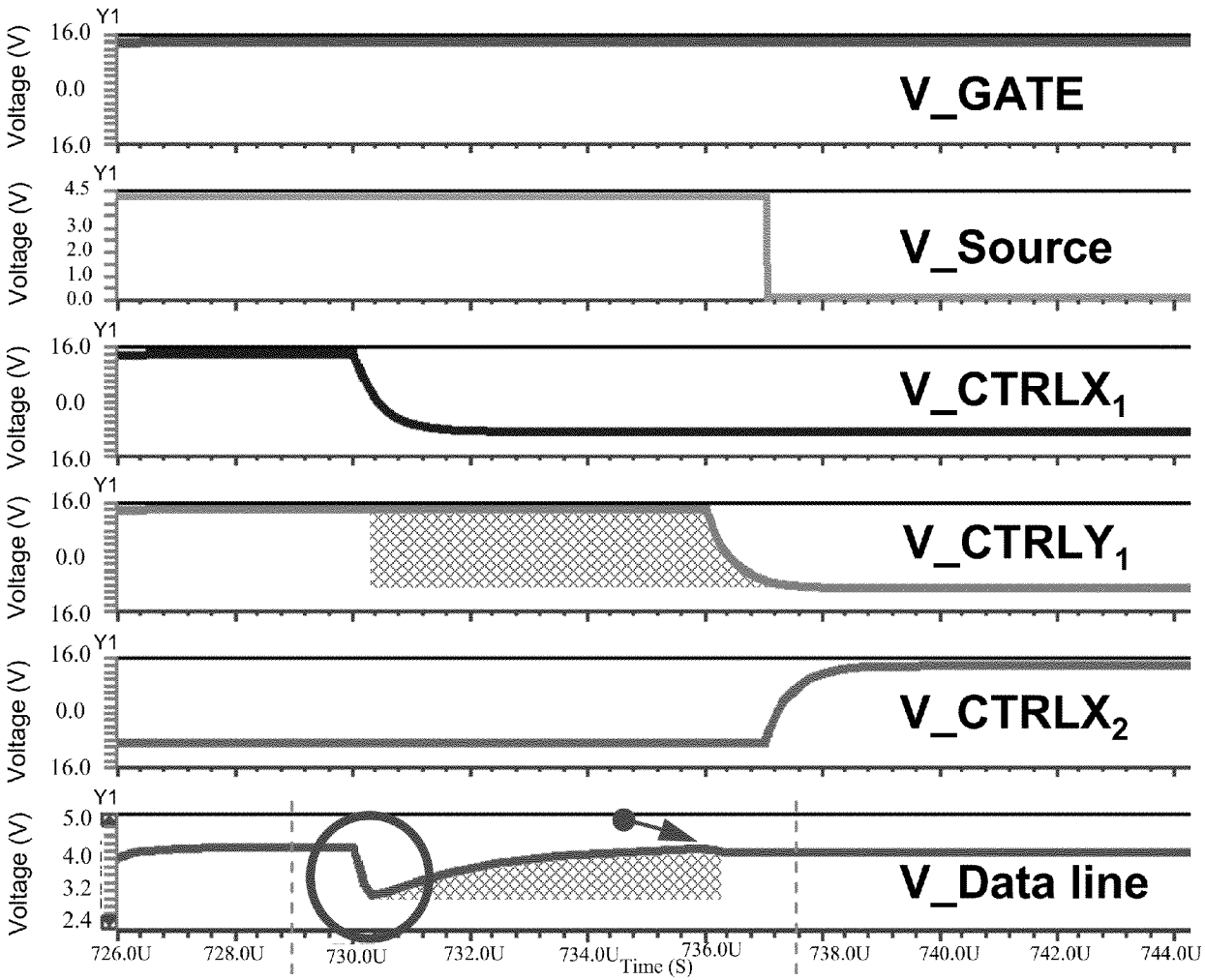
FIG. 2C shows schematically waveforms of simulations of the control signals and the simulated feed-through of the multiplexer $MUX_1$ shown in FIG. 2A according to one embodiment of the present invention.
Figure 2D:
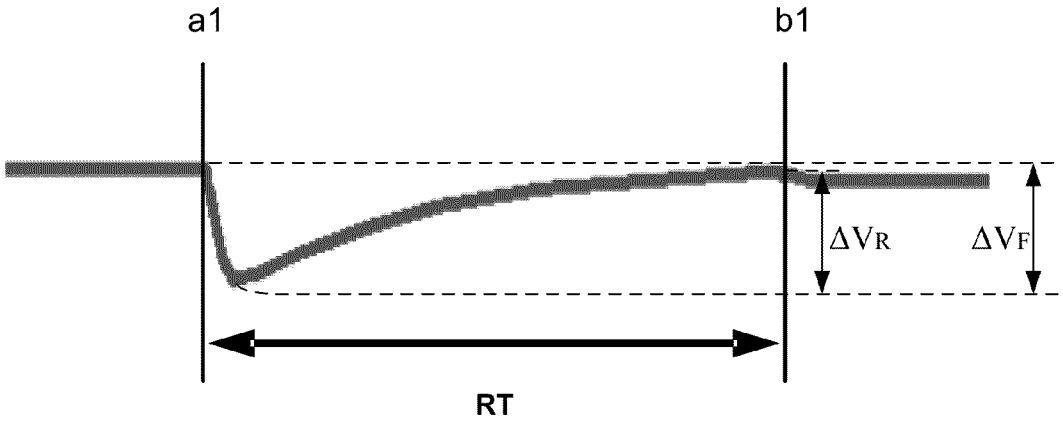
FIG. 2D shows partially an enlarged view of the simulated feed-through of the multiplexer $MUX_1$ shown in FIG. 2C according to one embodiment of the present invention.

FIG. 2C shows schematically waveforms the control signals and the simulated feed-through of the multiplexer $MUX_1$ shown in FIG. 2A according to one embodiment of the present invention, and FIG. 2D shows partially an enlarged view of the simulated feed-through of the multiplexer $MUX_1$ shown in FIG. 2C according to one embodiment of the present invention. According to FIGS. 2C and 2D, when the control signal $CTRLX_1$ goes from the high voltage to the low voltage at the falling time a1 to turn off the first switch $SWX_1$, the control signal $CTRLY_1$ maintains the high voltage for a certain period of time (the recovery time RT as shown in FIG. 2D) before reaching the falling time b1 to turn off the second switch $SWY_1$. Thus, the charging voltage for the data line is recovered during the recovery time RT.

As shown in FIG. 2D, after the falling time a1, a voltage drop $\Delta V_F$ would have occurred without the compensation of recovery time RT. The voltage drop $\Delta V_F$ is determined by a standard voltage difference $\Delta V_G$ of the gate of the switches $SWX_j$ and $SWY_j$ multiplies the capacitance ratio of the feed-through capacitor $C_j$ of each channel $CH_j$ to the total capacitance $C_{total}$ of the multiplexer. In other words, for each channel $CH_j$, the voltage drop $\Delta V_F$ is:

$$\Delta V_F = \Delta V_G * (C_j / C_{total})$$

In a simulation where the multiplexer has 2 channels $CH_1$ and $CH_2$ and the standard voltage difference $\Delta V_G$ is 23V (high voltage 14V and low voltage −9V), the simulated voltage drop $\Delta V_F$ is about 1.34V.

During the recovery time RT, the voltage drop $\Delta V_F$ would be recovered to a voltage recovered $\Delta V_R$ at the falling time b1. By increasing the recovery time RT, the voltage recovered $\Delta V_R$ at the falling time b1 would approach the original voltage before the voltage drop $\Delta V_F$ after the falling time a1. Thus, a feed-through recovery ratio is obtained as the ratio of the voltage drop $\Delta V_F$ to the voltage recovered $\Delta V_R$.

Figure 2E:
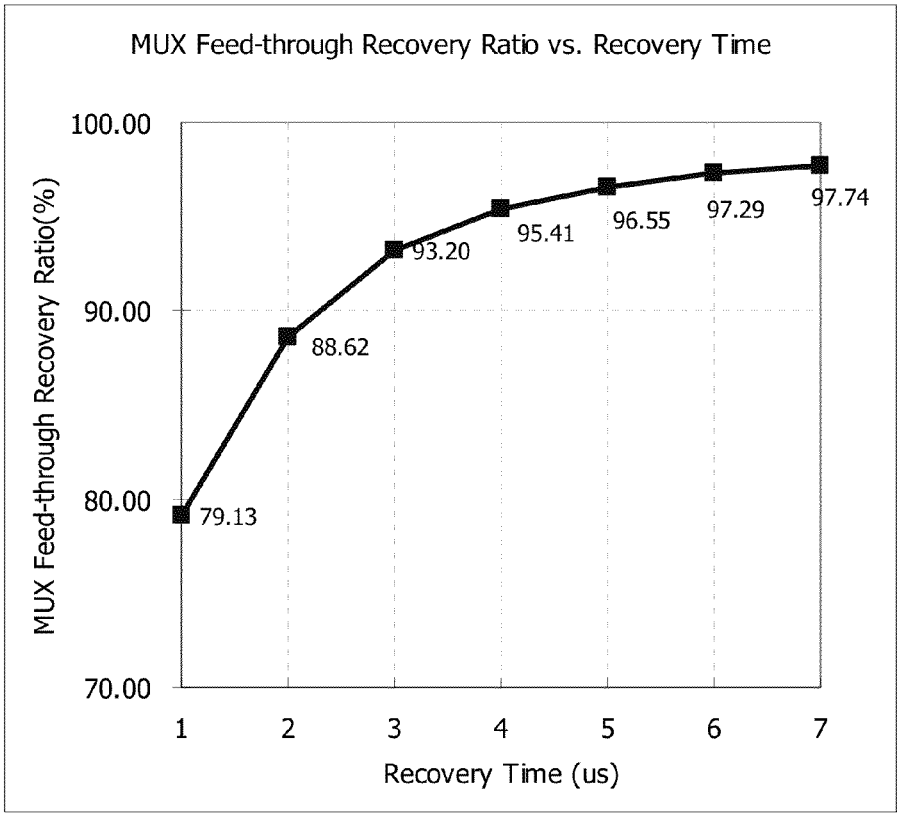
FIG. 2E shows a chart of the relationship between the feed-through recovery ratio and the recovery time of the multiplexer according to one embodiment of the present invention.

FIG. 2E shows a chart of the relationship between the feed-through recovery ratio and the recovery time of the multiplexer according to one embodiment of the present invention. As shown in FIG. 2E, the feed-through recovery ratio is over 95% when the recovery time RT is more than 4 μs, and over 97% when the recovery time RT is more than 6 μs. Accordingly, by adjusting the recovery time RT, a preferred feed-through recovery ratio can be obtained.

Figure 2F:
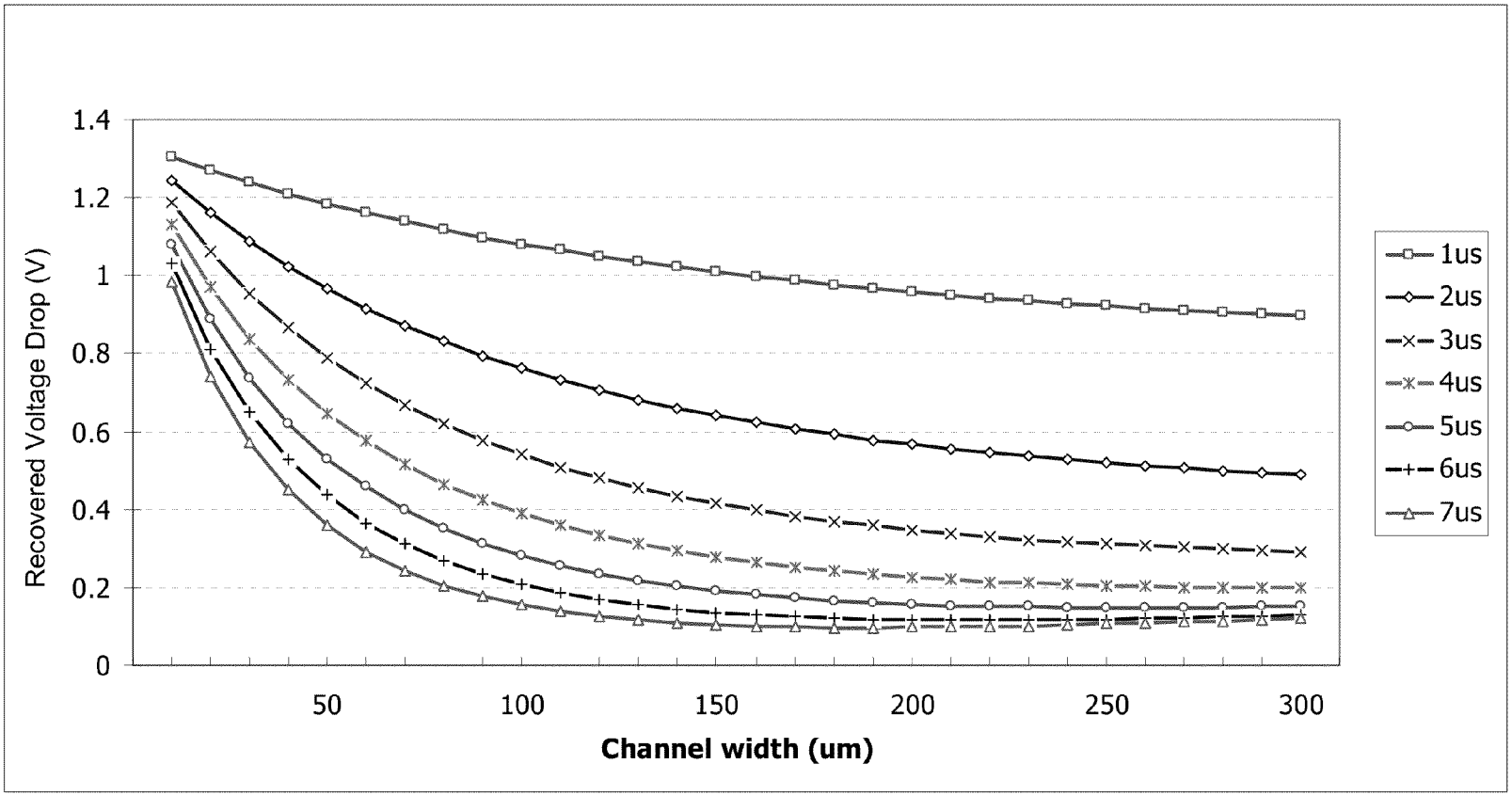
FIG. 2F shows a chart of the relationship between the recovered voltage drop and the channel width of the multiplexer according to one embodiment of the present invention.

FIG. 2F shows a chart of the relationship between the recovered voltage drop and the channel width of the multiplexer according to one embodiment of the present invention. The recovered voltage drop shown in FIG. 2F is the difference between the voltage drop $\Delta V_F$ and the voltage recovered $\Delta V_R$. As shown in FIG. 2F, the performance of the recovery is better with larger channel widths, particular the channel widths larger than 100 μm.

Figure 2G:
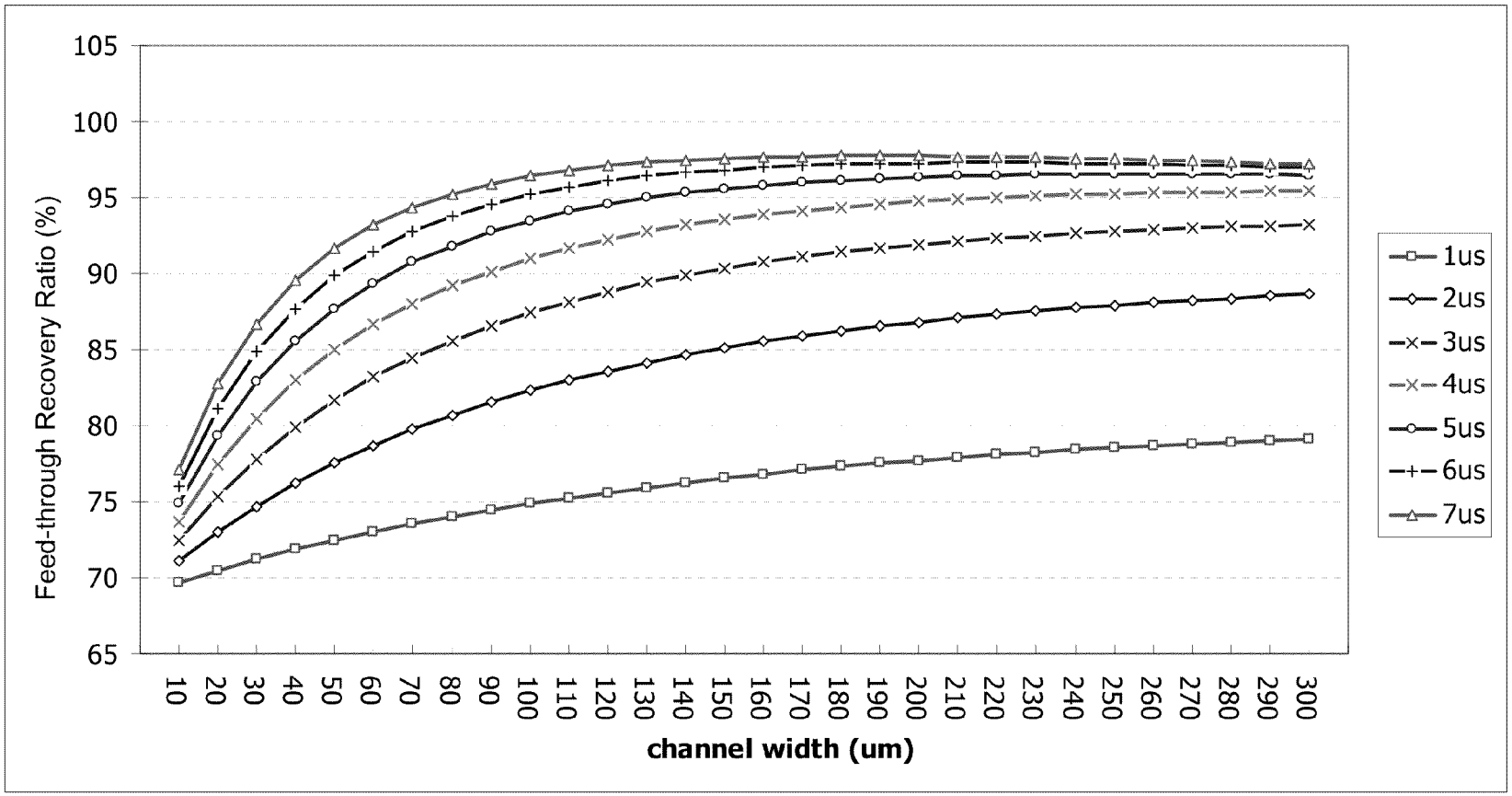
FIG. 2G shows a chart of the relationship between the feed-through recovery ratio and the channel width of the multiplexer according to one embodiment of the present invention.

FIG. 2G shows a chart of the relationship between the feed-through recovery ratio and the channel width of the multiplexer according to one embodiment of the present invention. As shown in FIG. 2G, when the channel width is larger than 100 μm and the recovery time RT is more than 6 μs, the feed-through recovery ratio is over 95%.

Figure 3A:
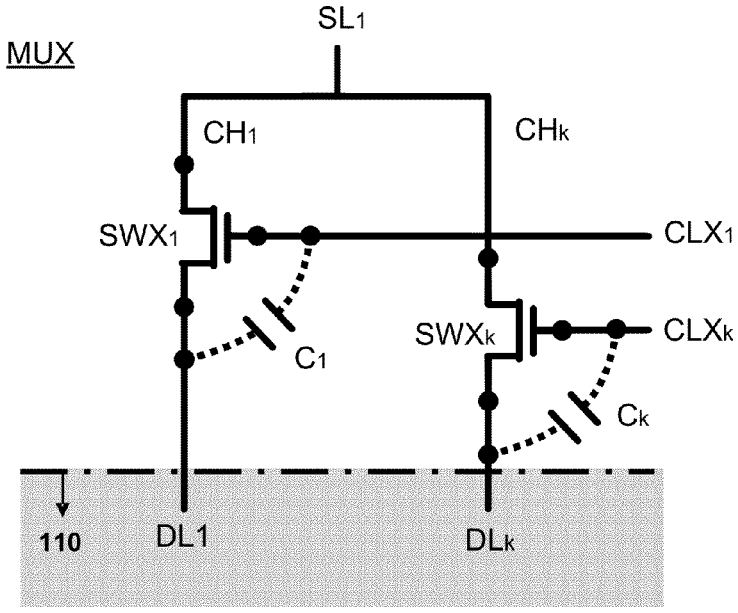
FIG. 3A shows schematically a multiplexer MUX of an LCD according to a comparative embodiment.
Figure 3B:
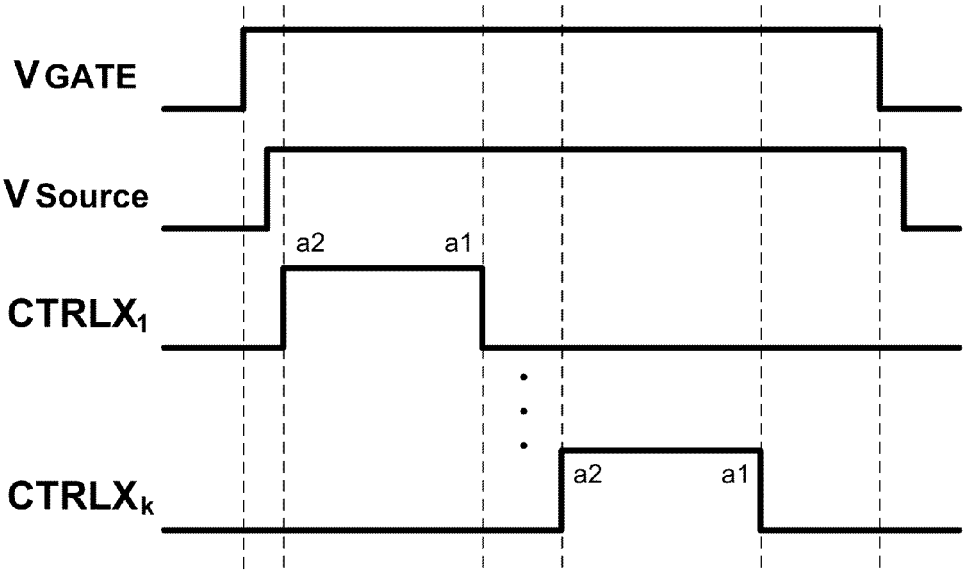
FIG. 3B shows schematically waveforms of the control signals of the multiplexer MUX shown in FIG. 3A according to a comparative embodiment.
Figure 3C:
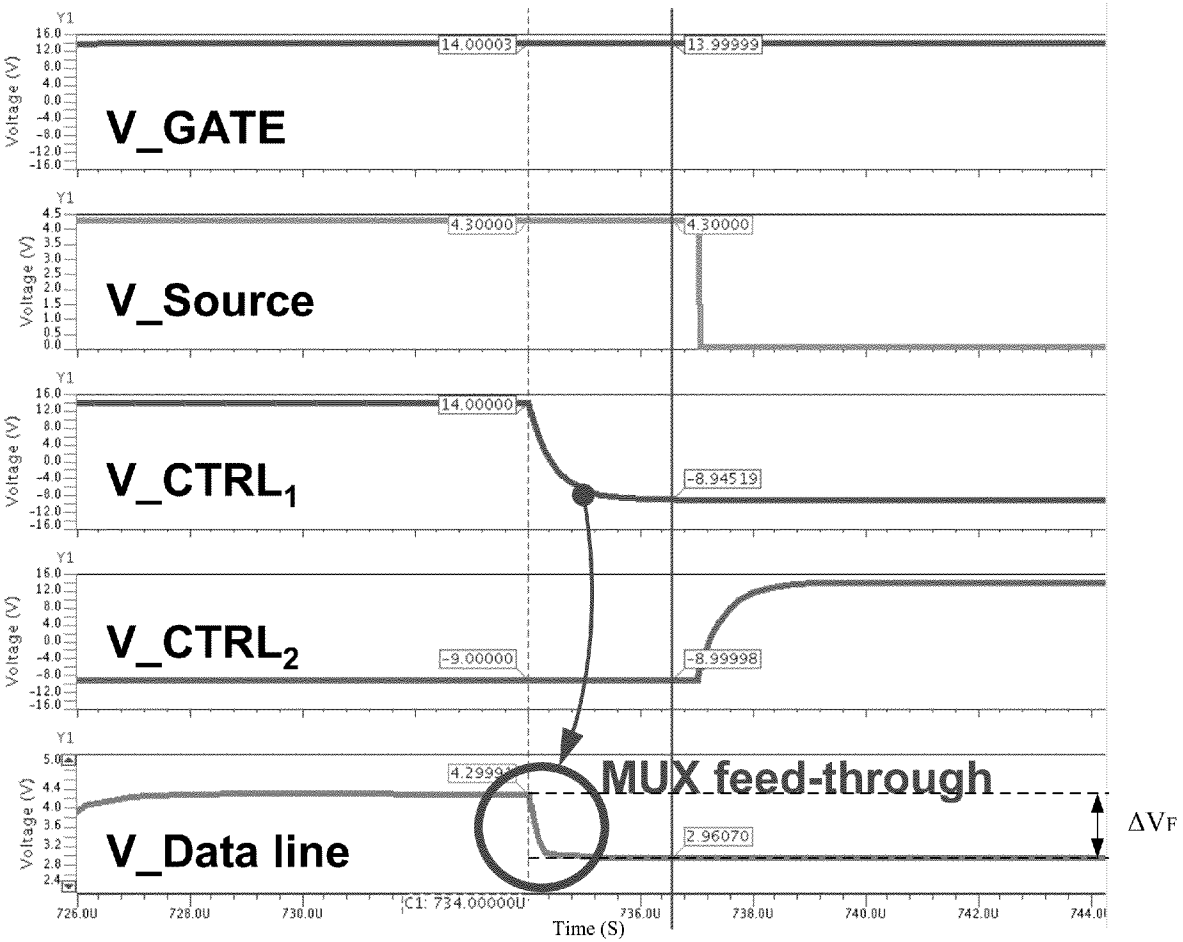
FIG. 3C shows schematically waveforms of simulations of the control signals and the simulated feed-through of the multiplexer MUX shown in FIG. 3A according to a comparative embodiment.

In comparison, FIGS. 3A-3C shows schematically a comparative example of a multiplexer MUX of an LCD. The difference between the multiplexer MUX shown in FIG. 3A and the multiplexer $MUX_1$ shown in FIG. 2A is that there is no second switches $\{SWY_j\}$ and the corresponding control lines $\{CLY_j\}$ in the multiplexer MUX shown in FIG. 3A.

FIG. 3B shows schematically waveforms of the control signals of the multiplexer MUX shown in FIG. 3A according to a comparative example. As shown in FIG. 3B, each of the control signals $CTRLX_j$ has a waveform defined by a low voltage, a high voltage, a rising edge from the low voltage to the high voltage at a rising time a2, and a falling edge from the high voltage to the low voltage at a falling time a1. For each control signal $CTRLX_j$, the rising time a2 is the time turning on a corresponding first switch $SWX_j$, and the falling time a1 is the time turning off the corresponding first switch $SWX_j$. Since there is no second switch $SWY_j$ and no corresponding control signal $CTRLY_j$ to the second switch $SWY_j$, there is no recovery time.

FIG. 3C shows schematically waveforms of simulations of the control signals and the simulated feed-through of the multiplexer $MUX_1$ shown in FIG. 3A according to the comparative example. As described above, for each channel $CH_j$, the voltage drop $\Delta V_F$ is:

$$\Delta V_F = \Delta V_G * (C_j / C_{total})$$

As disclosed above, in a simulation where the multiplexer has 2 channels $CH_1$ and $CH_2$ and the standard voltage difference $\Delta V_G$ is 23V (high voltage 14V and low voltage −9V), the simulated voltage drop $\Delta V_F$ is about 1.34V. Thus, according to the invention, a 95% feed-through recovery ratio would reduce the voltage drop $\Delta V_F$ from 1.34V to a recovered voltage drop of 0.07V.

According to the invention, each pair of control signals $CTRLX_j$ and $CTRLY_j$ is configured such that the first switch $SWX_j$ is turned off at the falling time a1 earlier than the falling time b1 when the second switch $SWY_j$ is turned off. However, the rising time a2/b2 can be configured in a variety of ways.

Figure 4A:
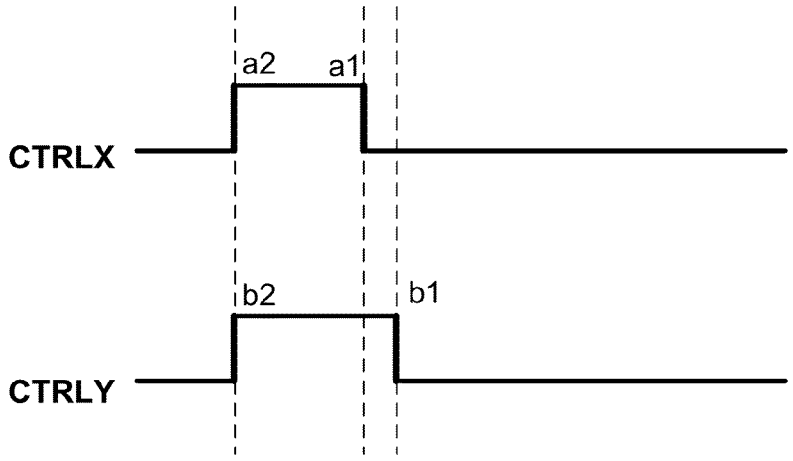
FIG. 4A shows schematically waveforms of the control signals of the multiplexer MUX according to one embodiment of the present invention, wherein the rising time b2 of the control signal $CTRLY_j$ is same as the rising time a2 of the control signal $CTRLX_j$, and the falling time b1 of the control signal $CTRLY_j$ is later than the falling time a1 of the control signal $CTRLX_j$.
Figure 4B:
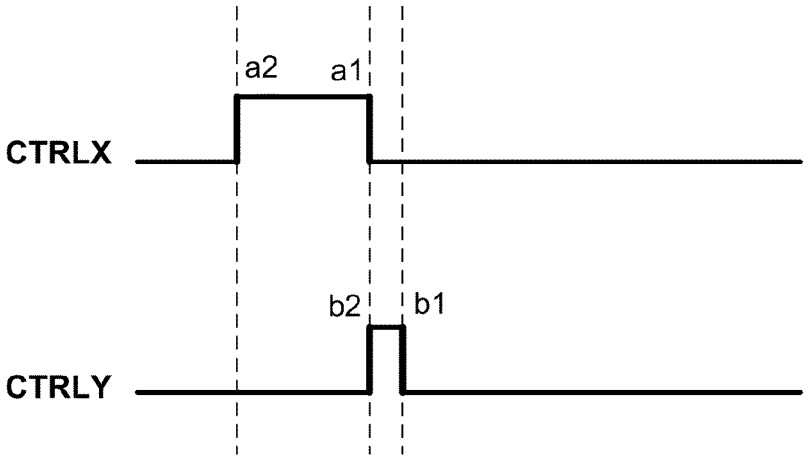
FIG. 4B shows schematically waveforms of the control signals of the multiplexer MUX according to one embodiment of the present invention, wherein the rising time b2 of the control signal $CTRLY_j$ is same as the falling time a1 of the control signal $CTRLX_j$ and the falling time b1 of the control signal $CTRLY_j$ is later than the falling time a1 of the control signal $CTRLX_j$.
Figure 4C:
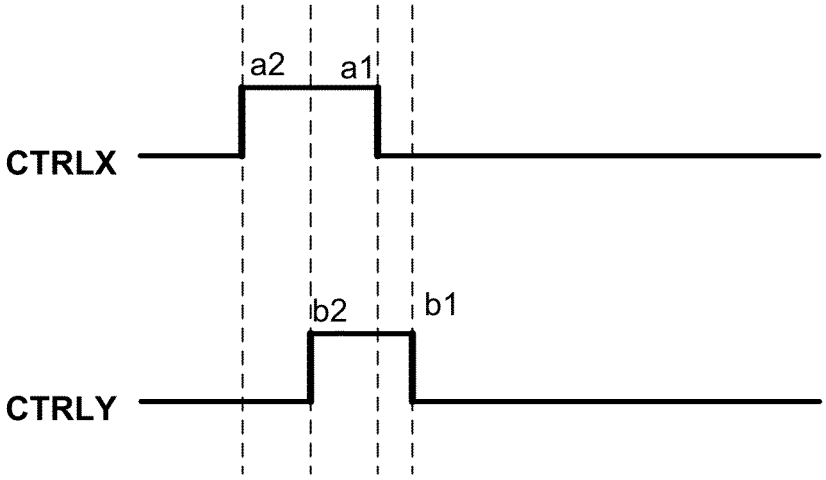
FIG. 4C shows schematically waveforms of the control signals of the multiplexer MUX according to one embodiment of the present invention, wherein the rising time b2 of the control signal $CTRLY_j$ is later than the rising time a2 but earlier than the falling time a1 of the control signal $CTRLX_j$ and the falling time b1 of the control signal $CTRLY_j$ is later than the falling time a1 of the control signal $CTRLX_j$.
Figure 4D:
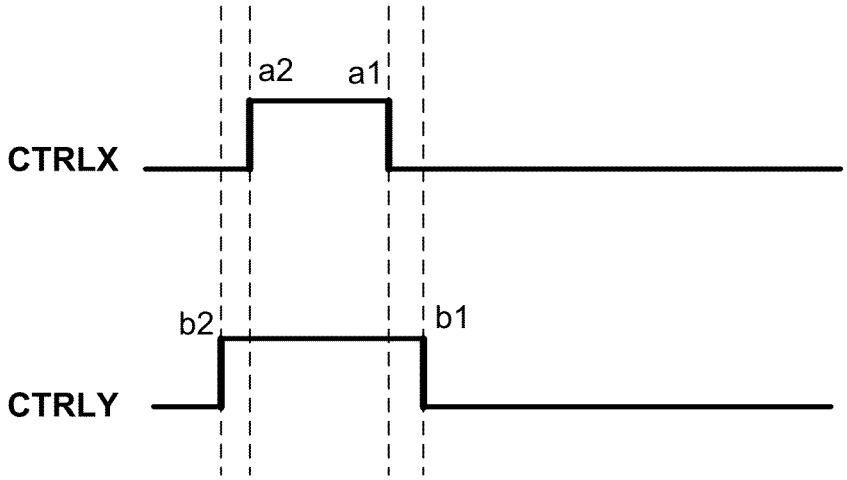
FIG. 4D shows schematically waveforms of the control signals of the multiplexer MUX according to one embodiment of the present invention, wherein the rising time b2 of the control signal $CTRLY_j$ is earlier than the rising time a2 of the control signal $CTRLX_j$ and the falling time b1 of the control signal $CTRLY_j$ is later than the falling time a1 of the control signal $CTRLX_j$.

FIGS. 4A-4B show schematically waveforms of the control signals of the multiplexer MUX according to different embodiments of the present invention. As shown in FIG. 4A, the rising time b2 of the control signal $CTRLY_j$ is same as the rising time a2 of the control signal $CTRLX_j$, and the falling time b1 of the control signal $CTRLY_j$ is later than the falling time a1 of the control signal $CTRLX_j$. As shown in FIG. 4B, the rising time b2 of the control signal $CTRLY_j$ is same as the falling time a1 of the control signal $CTRLX_j$ and the falling time b1 of the control signal $CTRLY_j$ is later than the falling time a1 of the control signal $CTRLX_j$. As shown in FIG. 4C, the rising time b2 of the control signal $CTRLY_j$ is later than the rising time a2 but earlier than the falling time a1 of the control signal $CTRLX_j$ and the falling time b1 of the control signal $CTRLY_j$ is later than the falling time a1 of the control signal $CTRLX_j$. Further, as shown in FIG. 4D, the rising time b2 of the control signal $CTRLY_j$ is earlier than the rising time a2 of the control signal $CTRLX_j$ and the falling time b1 of the control signal $CTRLY_j$ is later than the falling time a1 of the control signal $CTRLX_j$. All of these embodiments may achieve similar results of recovered voltage drop as shown in FIGS. 2E-2G.

One aspect of the present invention discloses a method for driving the above-disclosed LCD. The method in one embodiment includes the step of providing a multiplexer feed-through compensation circuit comprising: P multiplexers, $\{MUX_i\}$, where each multiplexer $MUX_i$ has an input electrically coupled to a corresponding signal line $SL_i$ for receiving a corresponding video signal $VS_i$ therefrom, and K channels, $\{CH_j\}$, each channel $CH_j$ comprising a first switch $SWX_j$ and a second switch $SWY_j$ parallel-connected between the input and a corresponding data line, for selectively transmitting the video signal $VS_i$ to the corresponding data line, where i=1, 2, . . . , P, j=1, 2, . . . , K, and P and K are integers greater than one; and K pairs of control lines, $\{CLX_j, CLY_j\}$. Each pair of control lines $CLX_j$ and $CLY_j$ is respectively and electrically coupled to the first and second switches $SWX_j$ and $SWY_j$ of a corresponding channel $CH_j$ of each multiplexer $MUX_i$.

The method also includes the step of applying K pairs of control signals $\{CTRLX_j, CTRLY_j\}$ to the K pairs of control lines $\{CLX_j, CLY_j\}$, respectively, such that each pair of control signals $CTRLX_j$ and $CTRLY_j$ is respectively and electrically coupled to the first and second switches $SWX_j$ and $SWY_j$ of the corresponding channel $CH_j$ of each multiplexer $MUX_i$ for turning on or off the first and second switches $SWX_j$ and $SWY_j$ thereof, thereby selectively transmitting the received signal line $SL_i$ to the corresponding data line. Each pair of control signals $CTRLX_j$ and $CTRLY_j$ are configured such that a time turning off one of the first and second switches $SWX_j$ and $SWY_j$ is earlier than that turning off the other of the first and second switches $SWX_j$ and $SWY_j$.

Each of the pair of control signals $CTRLX_j$ and $CTRLY_j$ has a waveform defined by a low voltage, a high voltage, a rising edge from the low voltage to the high voltage at a rising time, a2/b2, and a falling edge from the high voltage to the low voltage at a falling time, a1/b1, in a period, where for each control signal $CTRLX_j/CTRLY_j$, the rising time a2/b2 is the time turning on a corresponding switch $SWX_j/SWY_j$, and the falling time a1/b1 is the time turning off the corresponding switch $SWX_j/SWY_j$, and for each control signal $CTRLX_j/CTRLY_j$, the rising time a2/b2 is earlier than the falling time a 1/b1.

In one embodiment, each pair of control signals $CTRLX_j$ and $CTRLY_j$ is configured such that the rising time b2 of the control signal $CTRLY_j$ is same as the rising time a2 of the control signal $CTRLX_j$ and the falling time b1 of the control signal $CTRLY_j$ is later than the falling time a1 of the control signal $CTRLX_j$.

In another embodiment, each pair of control signals $CTRLX_j$ and $CTRLY_j$ is configured such that the rising time b2 of the control signal $CTRLY_j$ is same as the falling time a1 of the control signal $CTRLX_j$ and the falling time b1 of the control signal $CTRLY_j$ is later than the falling time a1 of the control signal $CTRLX_j$.

In yet another embodiment, each pair of control signals $CTRLX_j$ and $CTRLY_j$ is configured such that the rising time b2 of the control signal $CTRLY_j$ is later than the rising time a2 but earlier than the falling time a1 of the control signal $CTRLX_j$ and the falling time b1 of the control signal $CTRLY_j$ is later than the falling time a1 of the control signal $CTRLX_j$.

In a further embodiment, each pair of control signals $CTRLX_j$ and $CTRLY_j$ is configured such that the rising time b2 of the control signal $CTRLY_j$ is earlier than the rising time a2 of the control signal $CTRLX_j$ and the falling time b1 of the control signal $CTRLY_j$ is later than the falling time a1 of the control signal $CTRLX_j$.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A display, comprising:

(a) a display panel having a plurality of pixels arranged in a matrix having M pixel rows and N pixel columns, M scan lines electrically coupled to M pixel rows, respectively, and N data lines electrically coupled to N pixel columns, respectively, wherein M and N are integers greater than one;

(b) P signal lines for providing P video signals, wherein P is an integer greater than one;

(c) P multiplexers, wherein each multiplexer has an input electrically coupled to a corresponding signal line for receiving a corresponding video signal therefrom, and K channels, each channel comprising a first switch and a second switch parallel-connected between the input and a corresponding data line, for selectively transmitting the video signals, to the corresponding data line, wherein K is an integer greater than one; and (d) K pairs of control lines for providing K pairs of control signals, respectively, wherein each pair of control lines is respectively and electrically coupled to the first and second switches of a corresponding channel of each multiplexer for providing a corresponding pair of control signals for turning on or off the first and second switches thereof, thereby selectively transmitting the video signal to the corresponding data line, wherein each pair of control signals are configured such that a time turning off one of the first and second switches is earlier than that turning off the other of the first and second switches, wherein each of each pair of control signals has a waveform defined by a low voltage, a high voltage, a rising edge from the low voltage to the high voltage at a rising time, and a falling edge from the high voltage to the low voltage at a falling time, in a period, wherein for each control signal, the rising time is the time turning on a corresponding switch, and the falling time is the time turning off the corresponding switch, and wherein for each control signal, the rising time is earlier than the falling time; and wherein for each pair of control signals, the falling time of the second control signal is later than the falling time of the first control signal, and the rising time of the second control signal is one of same as the falling time of the first control signal, later than the rising time but earlier than the falling time of the first control signal, and earlier than the rising time of the first control signal.

2. The display of claim 1, wherein P*K=N.

3. The display of claim 1, wherein each of the first and second switches of each channel of each multiplexer has a channel width, wherein the channel width of the first switch is identical to or different from that of the second switch.

4. The display of claim 1, wherein each of the first and second switches of each channel of each multiplexer comprises a transistor having a gate, a source and a drain, wherein the gate, the source and the drain of the first switch are electrically coupled to the first control signal of the pair of control signals, the input of the multiplexer, and the corresponding data line, respectively, and wherein the gate, the source and the drain of the second switch are electrically coupled to the second control signal of the pair of control signals, the source of the first switch and the drain of the first switch, respectively.

5. A multiplexer circuit for a display panel, wherein the display panel has a plurality of pixels arranged in a matrix having M pixel rows and N pixel columns, M scan lines electrically coupled to M pixel rows, respectively, and N data lines electrically coupled to N pixel columns, respectively, wherein M and N are integers greater than one, comprising:

(a) P multiplexers, wherein each multiplexer has an input electrically coupled to a corresponding signal line for receiving a corresponding video signal therefrom, and K channels, each channel comprising a first switch and a second switch parallel-connected between the input and a corresponding data line, for selectively transmitting the video signal to the corresponding data line, wherein P and K are integers greater than one; and (b) K pairs of control lines for providing K pairs of control signals, respectively, wherein each pair of control lines is respectively and electrically coupled to the first and second switches of a corresponding channel of each multiplexer for providing a corresponding pair of control signals for turning on or off the first and second switches thereof, thereby selectively transmitting the video signal to the corresponding data line, wherein each pair of control signals are configured such that a time turning off one of the first and second switches is earlier than that turning off the other of the first and second switches, wherein each of each pair of control signals has a waveform defined by a low voltage, a high voltage, a rising edge from the low voltage to the high voltage at a rising time, and a falling edge from the high voltage to the low voltage at a falling time, in a period, wherein for each control signal, the rising time is the time turning on a corresponding switch, and the falling time is the time turning off the corresponding switch, and wherein for each control signal, the rising time is earlier than the falling time; and wherein for each pair of control signals, the falling time of the second control signal is later than the falling time of the first control signal, and the rising time of the second control signal is one of same as the falling time of the first control signal, later than the rising time but earlier than the falling time of the first control signal, and earlier than the rising time of the first control signal.

6. The multiplexer circuit of claim 5, wherein each of the first and second switches of each channel of each multiplexer comprises a transistor having a gate, a source and a drain, wherein the gate, the source and the drain of the first switch are electrically coupled to the first control signal of the pair of control signals, the input of the multiplexer, and the corresponding data line, respectively, and wherein the gate, the source and the drain of the second switch are electrically coupled to the second control signal of the pair of control signals, the source of the first switch and the drain of the first switch, respectively.

7. A method for driving a display panel, wherein the display panel has a plurality of pixels arranged in a matrix having M pixel rows and N pixel columns, M scan lines electrically coupled to M pixel rows, respectively, and N data lines electrically coupled to N pixel columns, respectively, wherein M and N are integers greater than one, comprising the steps of:

(a) providing a multiplexer circuit comprising:

P multiplexers, wherein each multiplexer has an input electrically coupled to a corresponding signal line for receiving a corresponding video signal therefrom, and K channels, each channel comprising a first switch and a second switch parallel-connected between the input and a corresponding data line, for selectively transmitting the video signal line to the corresponding data line, wherein P and K are integers greater than one; and K pairs of control lines, wherein each pair of control lines is respectively and electrically coupled to the first and second switches of a corresponding channel of each multiplexer; and (b) applying K pairs of control signals to the K pairs of control lines, respectively, such that each pair of control signals is respectively and electrically coupled to the first and second switches of the corresponding channel of each multiplexer for turning on or off the first and second switches thereof, thereby selectively transmitting the video signal to the corresponding data line, wherein each pair of control signals are configured such that a time turning off one of the first and second switches is earlier than that turning off the other of the first and second switches, wherein each of each pair of control signals has a waveform defined by a low voltage, a high voltage, a rising edge from the low voltage to the high voltage at a rising time, and a falling edge from the high voltage to the low voltage at a falling time, in a period, wherein for each control signal, the rising time is the time turning on a corresponding switch, and the falling time is the time turning off the corresponding switch, and wherein for each control signal, the rising time is earlier than the falling time; and wherein for each pair of control signals, the falling time of the second control signal is later than the falling time of the first control signal, and the rising time of the second control signal is one of same as the falling time of the first control signal, later than the rising time but earlier than the falling time of the first control signal, and earlier than the rising time of the first control signal.

8. The method of claim 7, wherein each of the pair of control signals has a waveform defined by a low voltage, a high voltage, a rising edge from the low voltage to the high voltage at a rising time, and a falling edge from the high voltage to the low voltage at a falling time in a period, wherein for each control signal, the rising time is the time turning on a corresponding switch, and the falling time is the time turning off the corresponding switch, and wherein for each control signal, the rising time is earlier than the falling time.

* * * * *